United States Patent [19]

Bohanon, Sr.

[11] 4,445,426

[45] May 1, 1984

[54] SLANTED HOUSING FAN ENCLOSURE

[75] Inventor: Hoy R. Bohanon, Sr., Muskogee, Okla.

[73] Assignee: Acme Engineering & Manufacturing Corporation, Muskogee, Okla.

[21] Appl. No.: 463,010

[22] Filed: Feb. 1, 1983

Related U.S. Application Data

[63] Continuation of Ser. No. 273,247, Jun. 12, 1981, abandoned.

[51] Int. Cl.[3] ..... F24F 13/06

[52] U.S. Cl. ..... 98/116; 98/43 R

[58] Field of Search ..... 98/43 R, 94 R, 116

[56] References Cited

U.S. PATENT DOCUMENTS

| | | | |
|---|---|---|---|
| 1,844,911 | 2/1922 | Shuman | 98/43 R X |
| 1,890,758 | 12/1932 | Townsend | 98/43 R |
| 1,971,356 | 8/1934 | Shurtleff | 98/43 R X |
| 2,552,966 | 5/1951 | Harp | 98/116 |
| 2,632,377 | 3/1953 | Mader | 98/116 |
| 2,885,948 | 5/1959 | Oshins | 98/43 R X |
| 3,204,546 | 9/1965 | Krell | 98/43 R X |
| 3,606,593 | 9/1971 | Steiner | 98/43 R X |
| 3,977,311 | 8/1976 | Felter | 98/43 R X |
| 4,261,255 | 4/1981 | Anderson et al. | 98/436 |

*Primary Examiner*—Albert J. Makay
*Assistant Examiner*—Harold Joyce
*Attorney, Agent, or Firm*—Staas & Halsey

[57] ABSTRACT

The present invention is for a housing structure for enclosing a fan assembly comprising a drive motor and propeller fan coupled thereto, the housing structure being mounted externally of a building at a downwardly slanted angle thereto so that as airflow is effected through the building when the fan is operating the air exits the building in a downward direction. The entrance to the housing is normally provided with a plurality of moveable blades in a louvered shutter assembly which when in open position have a downward angle thereto corresponding to the downwardly slanted center line axis of the housing enclosure. A fan inlet guard is normally provided with release clips to permit the quick and easy removal of the guard for servicing of the fan structure. The housing also is provided with sufficient area adjacent to the intake opening for permitting installation of electrical wiring to the internal components.

7 Claims, 5 Drawing Figures

SLANTED HOUSING FAN ENCLOSURE

This is a continuation of application Ser. No. 273,247, filed June 12, 1981, now abandoned.

BACKGROUND OF THE INVENTION

1. Field of the Invention

This invention relates to housing enclosures for exhaust fans suitable for maintaining a controlled environment in a wide variety of buildings, including by way of example factories, poultry houses, barns and greenhouses.

2. Description of the Prior Art

There are a number of known housing enclosures for fan systems in buildings. However, these known devices are either aerodynamically inefficient, bulky and cumbersome, relatively expensive to build, install and maintain, or else have other undesirable characteristics.

Existing prior patents which may be pertinent to the invention are as follows:

| INVENTOR | PATENT NUMBER | DATE GRANTED |
|---|---|---|
| Simmons et al. | 1,739,082 | Dec. 10, 1929 |
| Townsend | 1,890,758 | Dec. 13, 1932 |
| Harp | 2,552,966 | May 15, 1951 |
| Mieczkowski et al. | 2,750,868 | June 19, 1956 |
| Hartsough | 3,285,153 | Nov. 15, 1966 |

The patent to Simmons et al., (U.S. Pat. No. 1,739,082) discloses a ventilator-type exhaust fan which may be mounted in a window pane for the purpose of exhausting kitchen odors, living room odors, etc. It uses a relatively high-speed motor directly driving an exhaust fan together with an adjustable intake damper for controlling back-draft from the unit.

The Townsend patent, (U.S. Pat. No. 1,890,758) is another exhaust fan type ventilator wherein the exhaust louvers are mounted externally of the unit and outside of the building being ventilated.

The Harp patent, (U.S. Pat. No. 2,552,966) discloses a ventilator unit for a dairy barn and poultry house mountable with the louver intake inside the building and an exhaust to the outside.

The patent to Mieczkowski et al, (U.S. Pat. No. 2,750,868) discloses an automatic system involving thermostatic and motor controls for control of the air temperature within the building in which the device is used.

The Hartsough patent, (U.S. Pat. No. 3,285,153) discloses a structure for bringing air from outside of a building into the working area thereof.

None of the known prior art devices offers the new and unique features of the present invention.

SUMMARY OF THE INVENTION

An object of the present invention is a ventilating device which will effect energy savings with increased operating efficiency and reduced expense.

Another object of the present invention is to provide weather protection for the fan, motor, and connecting drive as contained within the fan enclosure.

A further object of the present invention is to provide for outside mounting of a fan housing which will create more useable space inside the building with which it is used.

An additional further object of the present invention is to provide a slanted housing fan enclosure which will thoroughly protect the inside operating components, which will provide for an already assembled fan housing structure for quick field installation, and which can also be equipped with inlet/outlet guards which may or may not be used, as desired, and which are provided with suitable clips which are quickly releasable when it is desired to remove or install the guards.

The present invention is for a new and improved housing enclosure of slanted construction and arrangement which will enclose a fan, drive motor therefor, and suitable drive connecting pulleys, belts etc., for complete weather protection of these components, and which is also provided with a moveable louvered intake shutter which is easily mounted and installed on the air intake side of the slanted housing before the intake of the fan itself such that increased overall efficiency of the fan is achieved.

Furthermore, the fan housing is specifically designed to increase the overall efficiency of exhausting air from the building with which it is used, and also to effect high airflow of increased capacity by reducing the required suction at the fan inlet. The housing will increase the inside useable space of the building because of the physical mounting of the fan enclosure in the wall and outside the building. That is, very little space is used inside of the building by the present invention.

The present invention reduces heat loss through the wall housing of the building in which it is mounted by placing the louvered shutters on the inside of the building, thus reducing the exposed area. It substantially increases the performance of the airflow effected by placing the fan in relationship to the louvered moveable shutter blades in such a position as to direct the airflow uniformly to the fan propeller as mounted and arranged in a slanted position.

Also, the device of the present invention is arranged such that the inside shutter blades open automatically when the fan is first turned on achieving thereafter a very smooth airflow as compared to a very turbulent flow when the shutter blades are mounted on the discharge of the fan propeller. The overall effect of this improvement is a reduction of the back pressure on the fan propeller which greatly increases the overall efficiency and performance of the device.

The device is also designed so that it is just as high as it is wide with a square shape of the housing inlet for attachment to a building. This square shape arrangement provides space along the edge for an electrical wiring knock-out at the top of the device to permit direct connection of the required electrical supply wiring to the fan motor inside the housing and yet maintain such connection covered and unexposed.

Another important advantage of the slanted arrangement of the housing enclosure is the protection of its motor and drive components as well as the propeller fan itself from the elements, bad weather, and the like, while also allowing for better drainage if moisture, rain, etc., should get inside the enclosure.

Advantages of the present arrangement over conventional fan housing types are that a substantial reduction in heat loss through the fan housing during non-operation thereof is effected since the only exposed shutter area is on the inside of the housing instead of outside thereof. The device also substantially reduces flow interference between the shutter and the vortex flow at the fan discharge, which interference conventionally creates a large effective head pressure and substantially reduces the air flow through the conventional fan enclosure package. Instead of an outside mounting of the louvered shutter blades, the shutter blades are mounted inside in a region of smooth air flow and at such an angle that the normal direction of the opened blades is directly in line with the slightly downward flow of air through the fan propeller. That is, when the louvered intake blades are open, they normally are positioned with a slightly downward angle because of their inherent weight and the off-center pivot axes thereof. However, in the present invention this slight downward angle is specifically designed to be in line with the slant of the center line axis of the housing of the present device.

Furthermore, with this new improved housing enclosure the louvered shutter is ideally located for maintenance and service, as well as permitting sufficient space at the top of the housing for making electrical wiring connections to the fan motor from inside of the building in which the enclosure is installed. The slant arrangement also provides protection for the fan and drive components from the elements, and when bad weather does occur the slant housing will provide for more practical drainage of moisture and rain which may get inside of the housing.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
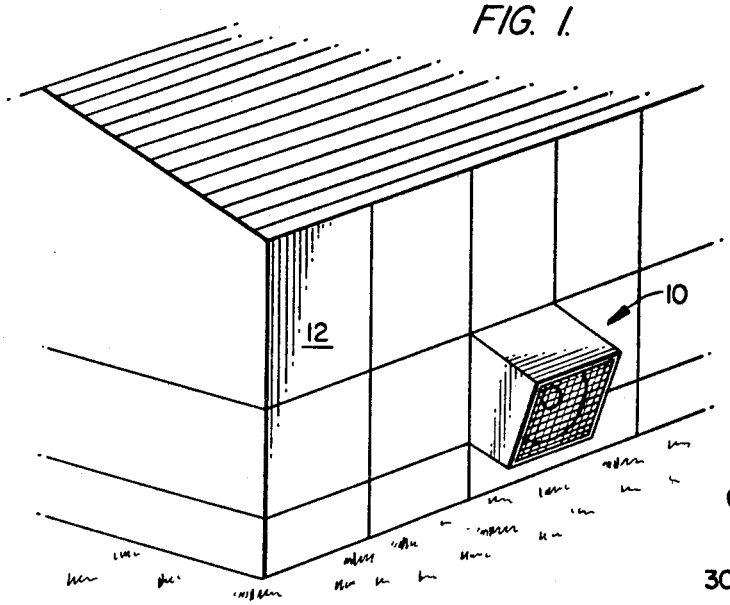
FIG. 1 is a perspective view of the present invention mounted within a wall of a building.

In FIG. 1 of the drawings, reference number 10 designates generally the slant housing enclosure of the present invention mounted on the end of a building 12.

Figure 2:
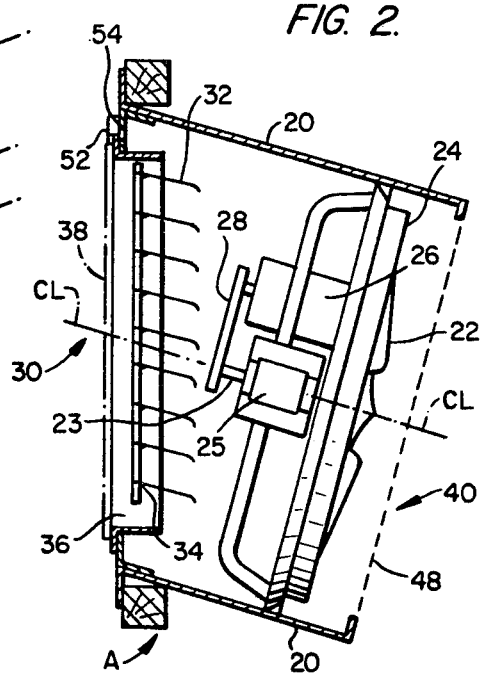
FIG. 2 is a side elevational view, partly in section, of the slanted housing enclosure together with the exhaust fan components mounted internally thereof.

With reference to FIG. 2, the housing enclosure comprises a substantially rectangular structure 20 having a square inlet area 30 and a square outlet area 40. Mounted within the housing enclosure, as best seen in the side elevation view of FIG. 2, is supporting framework for a propeller type fan 22, an orifice plate 24, a fan drive shaft 23 suitably supported in bearings 25, an electric drive motor 26 mounted from the support framework, and suitable pulleys and drive belt 28 for connecting the electric drive motor 26 to the fan drive shaft 23. This arrangement provides for a high RPM motor drive with reduced rotational speed of the fan itself for greater efficiency with less fan speed and thereby less noise.

Figure 3:
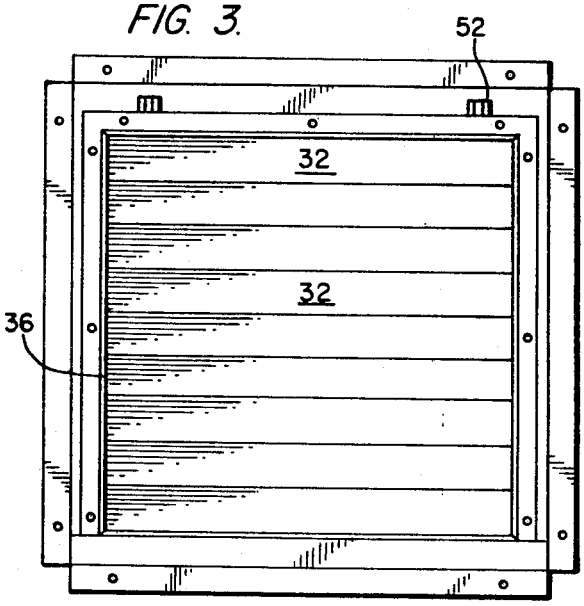
FIG. 3 is an elevational view of the inside intake end of the enclosure with louvered shutter arrangement.

As best seen in FIGS. 2 and 3 of the drawings, a louvered shutter arrangement is removably mounted at the inlet area 30 of the fan housing enclosure. This louvered shutter includes a plurality of pivotally mounted slats or blades 32, so arranged that when the fan drive motor 26 is energized, suction created by the fan 22 effects opening of the blades 32 to their normally full open position. However, because of the off center pivot mounting of the blades 32, and the weight of each blade 32, the blades 32 never open completely horizontally, but are slanted with a downward angle, as best seen in FIG. 2. The fan 22 and drive components therefor are mounted along the center line CL of the slanted housing enclosure such that the blades of the propeller 22 are substantially perpendicular to the center line CL. It will also be apparent from FIG. 2 that the direction of the air flow entering the slanted housing corresponds generally to the position of the blades or slats 32. Since the center line CL of the fan 22 and the position of the blades or slats 32 correspond, increased efficiency results because higher airflow capacity is achieved with reduced exhaust suction.

The material used for construction of the housing enclosure of the present invention is preferably heavy gauged galvanized steel, although aluminum, stainless steel, or other types of materials, even plastic, may be used.

The arrangement of the present device effects substantial energy savings because of the overall arrangement thereof and because of the inside louvered shutter structure. It has been discovered that savings in energy up to as high as 3,380 BTU per hour of reduced heat loss per each fan can be effected.

Also, the overall arrangement permits greater and higher airflow capacity than with conventional horizontally mounted fan structures. Normally, conventional horizontally mounted louvered shutters do not open to a position where the blades or slats are perfectly horizontal, i.e., the slats have a slight downward angle thereto because of their weight. Since the present invention has the fan propeller mounted in the slanted housing enclosure at an angle coinciding with the slant of the open blades of the louvered shutter, the airflow is more efficiently directed to the intake side of the propeller fan. It has been discovered that with this arrangement a suction of approximately 0.05 inches is all that is necessary to effect the proper airflow through the enclosure instead of the more common figure of 0.125 inches.

The slant housing enclosure also provides weather protection and protects the electric motor, the propeller fan, and the connecting drive components from the elements. Also, because of the outside and through the wall mounting of the enclosure the assembled fan and housing enclosure does not take up any inside space within the building. Thus, the entire inside of the building structure is useable (insofar as this device is concerned). For example, in a common type of inside mounted fan, the inside aisles of the building are sometimes blocked by the fan equipment and of course with the device of this invention, this would not be the case.

Also, the housing enclosure and fan components can be preassembled prior to field installation.

Figure 4:
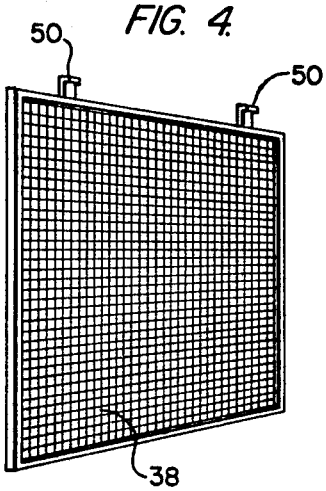
FIG. 4 is a perspective view of the removable guard for covering the intake louvered shutter arrangement and the quick release mounting clips for the guard.

Quick release clips 52 are utilized to support the outer frame 36 for the louvered shutter structure. This permits the quick and easy removal of the entire louvered shutter structure for quick access to the fan components mounted within the enclosure. As an option, an inlet guard 38 is provided, also suspended and mounted by quick release clips 50. This guard is shown in perspective in FIG. 4 and is preferably of welded galvanized wire having openings approximately ½ inch by 1 inch in the grid created thereby. These openings are of sufficient size to allow free airflow therethrough with minimum restriction, but will prevent anyone from putting their fingers, tools, or other items into the interior of the housing enclosure.

The quick release fastening clips 50 provided on the inlet guard 38 for the louvered shutter intake permit the guard 38 to be quickly removed for servicing of the internal components of the enclosure when necessary to do so.

Figure 5:
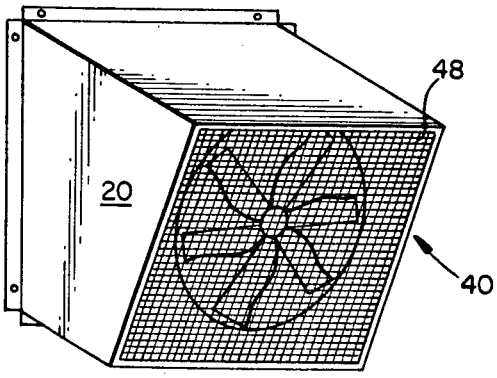
FIG. 5 is a perspective view of the slanted housing enclosure with the outlet protection guard grill installed therewith.

Installed as an integral part of the housing enclosure at the outlet area 40 is a guard 48 of similar construction to that of the inlet guard 38. The outlet guard 48, as seen in FIG. 5, is installed at the factory as an integral part of the housing enclosure for the protection of people outside the building.

Another important feature of the present invention lies in the mounting of the housing enclosure through the wall of the building with which it is being used. By so mounting the structure, support is provided for the weight of the housing enclosure at the position indicated by reference letter A in FIG. 2. In most installations, the housing enclosure is mounted high enough up the wall of the building such that the outer portion of the enclosure is above the heads of persons passing by.

Another feature of the present invention is the ability to provide electrical wire knock-outs at several points around the periphery of the inlet opening area 30, or at least along the upper frame edge 54 thereof. These knock-outs permit quick and easy wiring of the electric drive motor 26 and allow all wiring connections to the motor 26 to be made inside of the building, while eliminating any unslightly and perhaps dangerous outside wiring.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A housing and fan for mounting at an opening in in a wall of a building, comprising a housing lying along an axis and having an inlet opening and an outlet opening at respective ends thereof, said inlet opening of said housing being located in the vicinity of the opening within the wall of the building when said housing and fan are mounted in place; a first flange extending upwardly from the top of said housing at said inlet opening, said first flange lying along a plane which forms with said axis of said housing an angle greater than ninety degrees assisting in operatively connecting the top of said housing and the top of the opening in the wall; a second flange extending downwardly from the bottom of said housing at said inlet opening, said second flange lying along a plane which forms with said axis of said housing an angle less than ninety degrees assisting in operatively connecting the bottom of said housing and the bottom of the opening in the wall; said outlet opening of said housing being outside of the building and located a distance from the wall of the building when said housing and fan are mounted in place; and wherein the axis of said housing slants downwardly away from the building such that said outlet opening of said housing extends below said inlet opening of said housing;

a fan assembly mounted within said housing and having its axis generally aligned with said axis of said housing; and a plurality of shutter elements positioned at said inlet opening of said housing and mounted to move between open and closed positions, the angles said shutter elements assume when in open position being generally aligned with the angles of said axis of said housing and said axis of said fan assembly.

2. A housing and fan as in claim 1, wherein said second flange extends downwardly along substantially the entire width of said housing and bears against the wall of the building when said housing and fan are mounted in place.

3. A housing and fan as in claim 2, wherein said first flange extends upwardly along substantially the entire width of said housing and bears against the wall of the building when said housing and fan are mounted in place.

4. A housing and fan as in claim 1, wherein said inlet opening and said outlet opening of said housing are each rectangular in cross-section.

5. A housing and fan as in claim 1, further comprising an inlet guard positioned at said inlet opening of said housing on the inlet side of said shutter elements.

6. A housing and fan as in claim 5, further comprising an outlet guard positioned at said outlet opening of said housing.

7. A housing and fan as in claim 1, wherein said fan assembly further comprises a drive motor, a propeller fan with drive shaft, an orifice surrounding said propeller fan, support bearings for said drive shaft and a coupling belt drive between said motor and propeller fan and wherein the walls of said housing are solid protecting said fan assembly.

* * * * *

UNITED STATES PATENT AND TRADEMARK OFFICE

CERTIFICATE OF CORRECTION

PATENT NO. : 4,445,426

DATED : May 1, 1984

INVENTOR(S) : Hoy R. Bohanon, Sr.

It is certified that error appears in the above-identified patent and that said Letters Patent is hereby corrected as shown below:

Front Sheet, Item 63, delete ", abandoned".

Column 5, line 44, "in in" should be --in--.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*